US008272681B2

(12) United States Patent
Gücker et al.

(10) Patent No.: US 8,272,681 B2
(45) Date of Patent: Sep. 25, 2012

(54) PROCESS FOR PRODUCING A LOCALLY HARDENED PROFILE COMPONENT, LOCALLY HARDENED PROFILE COMPONENT AND USE OF A LOCALLY HARDENED PROFILE COMPONENT

(75) Inventors: Eike Gerhard Gücker, Bad Berleburg (DE); Michael Ohlwein, Baunatal (DE); Marco Abel, Grebenstein (DE)

(73) Assignee: Ulrich Schoof, Wetzlar (DE)

( * ) Notice: Subject to any disclaimer, the term of this patent is extended or adjusted under 35 U.S.C. 154(b) by 59 days.

(21) Appl. No.: 12/601,703

(22) PCT Filed: May 26, 2008

(86) PCT No.: PCT/EP2008/004172

§ 371 (c)(1),
(2), (4) Date: Nov. 24, 2009

(87) PCT Pub. No.: WO2008/145327

PCT Pub. Date: Dec. 4, 2008

(65) Prior Publication Data

US 2010/0156143 A1 Jun. 24, 2010

(30) Foreign Application Priority Data

May 26, 2007 (DE) ..... 10 2007 024 797

(51) Int. Cl.
*B62D 25/00* (2006.01)
*C21D 1/26* (2006.01)
*C21D 1/42* (2006.01)

(52) U.S. Cl. ..... 296/187.03; 148/559; 148/567

(58) Field of Classification Search ..... 296/187.03, 296/146.6, 188, 146.5; 148/559, 567, 400; *B62D 25/00; C21D 9/00, 1/26, 1/42*
See application file for complete search history.

(56) References Cited

U.S. PATENT DOCUMENTS

| | | | | |
|---|---|---|---|---|
| 3,829,149 | A * | 8/1974 | Stevens | 296/187.03 |
| 4,235,628 | A * | 11/1980 | Althoff et al. | 420/534 |
| 5,232,261 | A * | 8/1993 | Kuroda et al. | 296/146.4 |
| 5,256,219 | A * | 10/1993 | von Hagen et al. | 428/659 |
| 5,868,456 | A | 2/1999 | Kowalski et al. | |
| 6,086,685 | A | 7/2000 | Jöller et al. | |
| 6,227,609 | B1 * | 5/2001 | Mellis | 296/146.6 |

(Continued)

FOREIGN PATENT DOCUMENTS

| | | |
|---|---|---|
| CN | 1185359 A | 6/1998 |

(Continued)

*Primary Examiner* — Glenn Dayoan
*Assistant Examiner* — Sunsurraye Westbrook
(74) *Attorney, Agent, or Firm* — Laurence A. Greenberg; Werner H. Stemer; Ralph E. Locher

(57) ABSTRACT

A process for producing a profile component from a semi-finished sheet metal part, which at least in certain sections has a structurally increased strength. The semi-finished sheet metal part is formed in an at least a single-stage bending process. The bending process and also subsequent parting and cutting operations on the semi-finished sheet metal part are combined with a thermal treatment of at least one geometrically delineated region of the semi-finished sheet metal part. The thermal treatment comprises at least one heating step and is combined with a subsequent cooling step, in such a way that the at least one geometrically delineated region has a structurally increased strength after cooling. Bending can be effected by using roller profiling wherein rollers are preferably cooled or swage bending.

14 Claims, 15 Drawing Sheets

U.S. PATENT DOCUMENTS

| | | | | |
|---|---|---|---|---|
| 6,663,169 | B2 * | 12/2003 | Gehringhoff et al. | 296/187.12 |
| 6,793,743 | B2 * | 9/2004 | McNulty et al. | 148/320 |
| 6,817,652 | B2 * | 11/2004 | Graber et al. | 296/146.6 |
| 6,918,224 | B2 * | 7/2005 | Tjoelker et al. | 52/745.19 |
| 7,077,438 | B2 * | 7/2006 | Albers et al. | 293/102 |
| 2003/0157348 | A1 * | 8/2003 | Aldersley | 428/457 |
| 2005/0221011 | A1 * | 10/2005 | Eichner et al. | 427/372.2 |
| 2008/0196800 | A1 | 8/2008 | Beenken et al. | |

FOREIGN PATENT DOCUMENTS

| | | | |
|---|---|---|---|
| CN | 1254764 | A | 5/2000 |
| CN | 1699607 | A | 11/2005 |
| DE | 10120063 | A1 | 11/2002 |
| DE | 102005025026 | B3 | 10/2006 |
| EP | 1052295 | A2 | 11/2000 |
| WO | 9216665 | A1 | 10/1992 |

* cited by examiner

FIG. 12
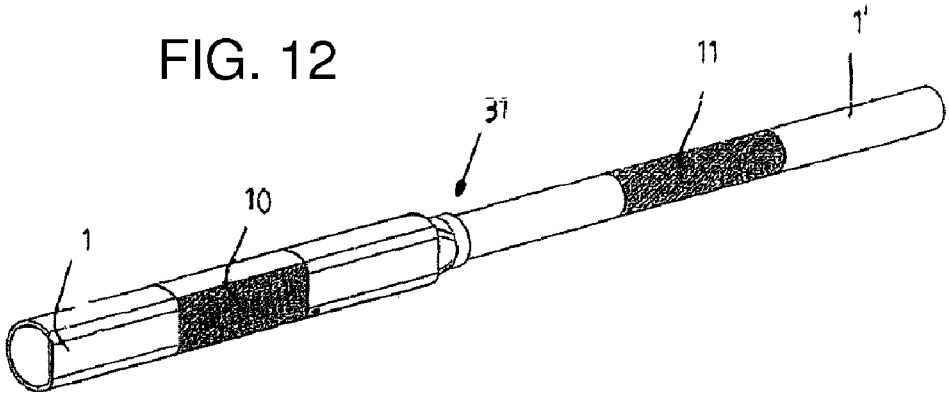
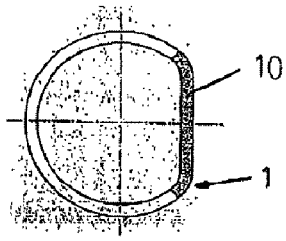
FIG. 13

PROCESS FOR PRODUCING A LOCALLY HARDENED PROFILE COMPONENT, LOCALLY HARDENED PROFILE COMPONENT AND USE OF A LOCALLY HARDENED PROFILE COMPONENT

BACKGROUND OF THE INVENTION

Field of the Invention

The present invention relates to a process for producing a profile component, which has at least in portions a structurally increased strength, from a sheet metal semifinished product. Furthermore, the present invention relates to a profile component with at least one spatially delimited region which has a structurally increased strength, and to a use of a profile component of this type.

Profile components having high structural strength are used, for example, in automobile construction for the production of structural parts, such as, for example, side impact beams, bumpers or reinforcements for A-, B- or C-columns of a motor vehicle. Since profile components of this type have to satisfy very stringent requirements with regard to their strength, high-strength, higher-strength and super-high-strength steels are often used to produce them. Various forming processes may be employed for profiling the profile components. For example, bending processes, in particular roll-profiling processes, may be mentioned at this juncture.

European Patent EP 1 052 295 B1 discloses a process for producing structural parts in automobile construction, which have, at least in regions, a high strength and a minimum ductility of 5% to 10%. In this process, the structural part is configured by means of a forming of sheet bars, strip steel (in particular, by roll-profiling) or tubes which takes place in a soft state, and is then brought at least partially to the austenitizing temperature required for hardening by means of a component-surrounding inductor following the structural part contour and movable with respect to the structural part and is subsequently cooled by means of a cooling unit tracking the inductor in the direction of movement. The process known from the abovementioned publication is distinguished primarily in that the structural part is positioned essentially vertically and the inductor is displaced along the structural part from the top downward, the inductor and the cooling unit being adjustable in relation to one another and being connected to a displaceable tool slide.

In the process disclosed in the abovementioned publication, therefore, the initial material is first formed in a still soft state into a profile component having a defined profile cross section. In order to acquire the desired strength, the profile component is hardened in a subsequent process step, in that it is heated to the austenitizing temperature and is subsequently cooled again. A defined cooling then brings about the desired hardening of the profile component. One disadvantage of this process known from the prior art is that the initial material always has to be brought into a soft state before it can be profiled and hardened.

DE 101 20 063 A1 and WO 92/16665 A disclose processes for the production of profile components, in which the flat initial material (sheet metal semifinished product) is first brought into its final contour by cold forming. Only thereafter does hardening (by heating and subsequent cooling) of at least partial regions of the profile component take place. The heating and cooling steps are then also followed, at most, by a calibrating step which, however, no longer serves for the actual production of the profile geometry. Merely accidental deviations in geometry which have occurred due to the thermal action of the process are thereby subsequently corrected. When WO 92/16665 A speaks of hardening being followed by further shaping operations, no further roll-profiling steps are meant, but entirely alternative forming operations (for example stationary bending or stamping operations).

DE 101 20 063 A1 discloses a further variant of a process for producing a profile component, in which the initial material (sheet metal semifinished product) is at an increased temperature during shaping and therefore has a higher forming capacity. It remains unclear, however, how, in this process, heat dissipation and therefore an undesirable increase in hardness of the material in contact with the forming tools can be avoided in practice.

DE 103 39 119 B3 discloses a process for producing a profile component, which provides partial or complete hardening by means of heating and subsequent cooling before actual shaping. In this case, the hardened regions are in any event formed after hardening.

BRIEF SUMMARY OF THE INVENTION

The object on which the present invention is based is to make available a process for producing a profile component, which makes it possible to produce profile components with defined zones of different material and geometric properties tailored to later further processing and/or use. Furthermore, the object on which the present invention is based is to make available a profile component with defined zones having different material and geometric properties tailored to later further processing and/or use and to propose a use of a profile component of this type.

With regard to the process, the object on which the present invention is based is achieved by means of a process having the features of the claims. With regard to the profile component, the object on which the present invention is based is achieved by means of a profile component having the features of the claims directed to that component, and, with regard to the use of the profile component, by means of a use having the features of the claims directed to the combination of the component and a vehicle. The subclaims relate to advantageous and especially expedient developments of the present invention.

In a process according to the invention for producing a profile component which has at least in portions a structurally increased strength, according to claim 1 a sheet metal semifinished product is formed in at least one single-stage bending process, and the bending process and also subsequent operations for separating and cutting the sheet metal semifinished product are combined with a thermal treatment of at least one spatially delimited region of the sheet metal semifinished product, which comprises at least one heating step and one cooling step following this, in such a way that the at least one spatially delimited region has, after cooling, a structurally increased strength. The sheet metal semifinished product may be made available to the above described process, for example, in strip form as a coil. With the aid of the process according to the invention, profile components with an open, with a partially open or else with a completely closed profile cross section can be produced. There is, furthermore, the possibility that the profile components have over the entire profile length, at least in portions, different (changing) profile cross sections, so that, in principle, profile components with configurations and cross-sectional forms of any desired complexity can be produced.

By means of a directed dissipation of the heat introduced at least into a spatially delimited region of the sheet metal semifinished product, a strength increase by means of a phase transformation can advantageously be achieved during cooling in this region. In this case, those materials are to be preferred for the sheet metal semifinished product which in the case of sufficient austenitization, above a transformation temperature (austenitizing temperature) $A_{r3}$, at which the transformation from austenite to ferrite commences during cooling, are capable of developing a martensitic microstructure at sufficiently rapid cooling rates. A martensitic microstructure is characterized by super-high strengths. This advantageous behavior is exhibited, for example, by tempering steels of the type 22MnB5 of which the sheet metal semifinished product may consist.

The dissipation of heat from the at least one preheated region may take place at least partially by means of a direct contact of the sheet metal semifinished product with the bending tool which, if required, may also be operated, cooled. In addition, the use of liquid-based or gas-based cooling devices is possible in order to cool the sheet metal semifinished product on a media basis.

The particular advantage of the solution proposed here is that profile components having hardness properties adapted in a directed manner can be produced. Thus, for example, it is possible to produce a profile component which in portions has hardened regions and in portions has non-hardened regions. The hardened regions may be partially hardened, completely hardened or else partially hardened in portions and completely hardened in portions.

In a preferred embodiment of the process, it is proposed that the sheet metal semifinished product be bent stationarily. For example, the stationary bending of the sheet metal semifinished product may take place by means of die-bending.

In a particularly preferred embodiment, it is proposed that the bending of the sheet metal semifinished product take place in a roll-profiling device by means of roll-profiling with a number of successive rolling steps. The sheet metal semifinished product is in this case bent in the roll-profiling device continuously in a plurality of successive profile-rolling passes and thus brought into the desired profile shape. By means of roll-profiling, in particular, even comparatively complex profile shapes and profile cross sections can be generated. During profile production in a continuous roll-profiling process, a superposition of thermal and mechanical mechanisms can be achieved in an especially advantageous way. As a result of the stepwise combination of local heat generation, shaping, including the cutting and separation operations, necessary if appropriate, and cooling, specific zones of increased strength can be established accurately in terms of their arrangement and microstructural configuration.

A local spatial heating of the sheet metal semifinished product can advantageously be achieved by an inductive generation of an electromagnetic field or by a conductive current throughflow by means of the electrical resistance (or by a combination of these two processes), that is to say by the dissipation of electrical energy. There is also the possibility, in further advantageous embodiments, that the heat is introduced into defined regions of the sheet metal semifinished product by means of one or more laser light sources, by means of an infrared radiation source or by means of a gas burner. Laser light sources have the advantage that the laser light generated by them can, for example, be focused by simple means even onto a comparatively small spatially delimited region of the sheet metal semifinished product, in order to give rise in this region to local heating to a desired temperature. Preferably, heating does not take place solely by means of heating devices, specifically integrated for this purpose into the process sequence, on an inductive or else conductive basis (for example, by means of inductors or conductive contact elements), but, instead, by means of electrical resistance heating during the contact with the shaping tools (rolling rolls) which in any case takes place for the purpose of transmitting the shaping force.

Cooling advantageously does not take place solely via a direct dissipation of heat by the action of fluid coolants (preferably water) and/or gaseous coolants (preferably compressed air), but also by heat conduction via the contact of the sheet metal semifinished product with the shaping forming tools (for example, with rolling rolls of a roll-profiling device). The rolling rolls may be equipped for this purpose with internal cooling in which heat is transported away via a cooling medium through corresponding cooling ducts in a circulation system which are introduced into the interior of the tool. Consequently, heat dissipation can especially advantageously be controlled substantially more accurately with the effect of the direct establishment of a microstructure than is conceivable at all by means of straightforward media cooling.

The cooling of the sheet metal semifinished product may take place, in an especially advantageous embodiment, by heat conduction via contact with the shaping tools (rolling rolls), in combination with a direct cooling of the sheet metal semifinished product, for example by means of a gas (if appropriate, subcooled) or with particularized ice (preferably dry ice). In this case, the gas or dry ice is blasted with high pressure into the exit of the roll stand onto the sheet metal semifinished product surface (rolling stock surface) on both sides. In this case, especially advantageously, a cooling of the rolling rolls can take place simultaneously as a result of blasting into the roll nip. Advantageously, by means of the particularized ice, additional surface dirt and/or oxidation residues, scale or the like are removed from the surface of the rolling stock (sheet metal semifinished product) and/or from the surfaces of the rolls. Consequently, the controllability of heat dissipation is substantially improved once again to the effect that a microstructure is established in a directed manner. This cannot be achieved at all in this way by means of straightforward quench cooling by means of fluid or gaseous cooling media, such as is used in the prior art.

In a preferred embodiment, there may be provision for the heating of at least one region of the sheet metal semifinished product to take place before bending. This embodiment is preferred particularly in the case of a stationary bending of the sheet metal semifinished product.

The production of a profile component, at the same time with the action of heat, can improve the processing properties during shaping in an especially advantageous way, since the deformation resistance can be lowered in a directed manner in each case immediately before the deformation caused locally via the bending tools or the material separation caused by special cutting tools. A sheet metal semifinished product preheated at least in regions advantageously has in these regions reduced resistance to the desired deformation during the bending process.

According to a further especially advantageous embodiment, a plurality of regions of the sheet metal semifinished product which are to be heated are preheated in succession, each heating step being followed by a bending and cooling step.

According to an alternative, likewise advantageous variant of the production process, the sheet metal semifinished product is first bent in a plurality of bending steps into the desired geometric shape of the profile component and is subsequently heated at least in portions. In this variant, the strength properties desired for the later further processing and/or use of the profile component can be set in an especially advantageous way. In this embodiment, therefore, the heating of the profile component takes place only after shaping has been concluded and preferably also after a component trimming, necessary if appropriate, has been carried out. In this case, the dissipation of heat from the preheated regions of the sheet metal semi-finished product may take place via corresponding cooling media which follow the actual forming process.

During cooling, an undesirable component distortion may sometimes occur. Furthermore, in the case of pronounced temperature gradients, a component failure due to crack formation may occur on account of locally different volume expansions in the workpiece. In an especially advantageous embodiment, both effects can be suppressed by the superposition of mechanical stresses in a calibrating tool and by a corresponding heat dissipation via heat conduction. It may in this case be expedient, in this variant of the process, to carry out a profile component trim, necessary if appropriate, even before the thermally induced hardening.

With the aid of the process presented within the scope of the present invention, the hardness properties of a profile component which is produced by the single-stage or multiple-stage bending of a sheet metal semifinished product can be adapted in a directed manner to different later uses of the profile component.

It has been shown that virtually any variant of the introduction of regions of increased strength into the profile component by means of a directed local introduction of heat during profiling leads to an improvement in the functional behavior of the profile component. Furthermore, on the basis of this improved functional behavior, a weight reduction can be achieved in an especially advantageous way by a sheet metal thickness reduced in comparison with a component not influenced thermally, without any losses in behavior during use.

One advantage of the process presented here is that the forming of previously thermally treated hardened regions of the sheet metal semifinished product is avoided on account of their low formability and of the failure risk resulting from this and, furthermore, also on account of the high forming forces to be expected. In other words, therefore, only those regions of the flat initial material are subjected to partial thermal treatment by heating and cooling which do not undergo any direct forming during the subsequent roll-profiling.

In the present case, the partial heating of the sheet metal semifinished product serves not only for initiating heat treatment with the aim of establishing a defined microstructure state, but also for increasing the forming capacity of the basic material of which the sheet metal semifinished product consists to an extent such that a defect-free forming is achieved to a desired extent by means of the process forces available in each individual forming step. In this case, this increase is based, on the one hand, on the higher processing temperature per se and, on the other hand, on thermally induced softening actions proceeding simultaneously. This cannot and should not occur only before the entry of the initial material into the sequence of roll-profiling steps, but preferably also between the individual forming steps during roll-profiling.

In the process presented here, there is the possibility that the heat treatment of the sheet metal semifinished product does not take place before the commencement of the actual profile production by roll-profiling or after profile forming has occurred, but, instead, takes place in a directed manner in a plurality of intermediate steps. In this case, these heat treatment intermediate steps are positioned according to clear methodical principles:

positioning of local heat treatment according to the need for a simultaneous increase in the local forming capacity, positioning of local heat treatment whenever the strain hardening which has taken place in the preceding cold-forming steps has led to a residual forming capacity which is not sufficient for further forming and which, by thermally induced softening, can be increased again to the extent necessary for subsequent forming, positioning of local heat treatment whenever the respective geometric regions of the sheet metal semifinished product are not exposed to any appreciable forming during the further process sequence.

According to the claims, a profile component according to the invention with at least one spatially delimited region which has a structurally increased strength is distinguished in that it is produced by means of a process as claimed in the present application. In advantageous embodiments, the profile component may have at least one partially hardened region and/or at least one fully hardened region and/or at least one region which is fully hardened in portions and is partially hardened in portions. There is, moreover, the possibility that the profile component has over its profile length, at least in portions, different profile cross sections. Furthermore, in an especially advantageous embodiment, the profile component may have over its profile length, at least in portions, different (changing) strength properties.

In a use according to the invention, as recited in certain claims, at least one profile component as claimed is used for producing a component which is suitable for the guidance and energy absorption of movable components and devices of a vehicle. Precisely in components of this type, the use of the at least partially hardened profile components produced according to the process described above is especially advantageous.

For example, a guide rail for a safety belt with increased deformation resistance can be produced from a profile component of this type, so that, in an especially advantageous way, an essentially slide-shaped belt fastening can be effectively prevented from coming loose from the guide rail.

In an advantageous embodiment, the profile component may also be used to produce a guide rail for a safety belt with increased resistance to contact-related wear during the adjustment of the slide-shaped belt fastening.

A further preferred example of the use of the profile component is the production of seat fastening rails with increased deformation resistance, so that the vehicle seat can advantageously be prevented from coming loose from its vehicle-side fastening.

For example, seat fastening rails with increased resistance to contact-related wear during the adjustment of the seat position can also be produced from the profile component.

A further advantageous example of a use of the profile component is the production of a side wall guide rail for a side wall sliding door of a motor vehicle, the side wall guide rail having increased resistance to contact-related wear during the opening and closing of the door.

Furthermore, a side wall guide rail for a sliding door can be produced from the profile component, which has increased deformation resistance, as compared with the solutions known from the prior art, in order thereby to prevent a structural failure and a loosening of the side wall sliding door in the event of an accident.

In the use according to the invention, as claimed, at least one profile component as claimed is used for the production of a structural component which has increased resistance to intrusion and is suitable for the absorption and breakdown of active energy via material or component deformation. In components of this type, too, the use of the at least partially hardened profile components produced according to the process described above is especially advantageous, since the strength properties of the profile components can be set gradually.

For example, a part of a module crossmember for a cockpit of a motor vehicle with increased deformation resistance can be produced from the profile component, so that a structural failure in the event of an accident due to the action of force upon the steering column can be effectively avoided.

A further example of the use of a profile component is the production of a part of a module crossmember for a cockpit with increased deformation resistance, in order in an especially advantageous way to prevent a structural failure in the event of an accident due to the action of force by an airbag module.

The module crossmember may, in particular, be an instrument panel member.

A further advantageous use of the profile component is the production of a module crossmember (in particular an instrument panel member) with an optimized characteristic frequency behavior, in order to avoid undesirable vibrations and consequently improve the acoustics in the interior of the vehicle.

In a further advantageous embodiment, for example, a member (longitudinal member or crossmember) with increased deformation resistance can also be produced from a profile component, in order to prevent a structural failure in the region of the A-, B- and C-column of the motor vehicle in the event of a front or side impact.

Furthermore, the profile component may also be used, for example, for producing a bumper member with increased deformation resistance, in order advantageously to prevent a structural failure in the region of the crash boxes of the motor vehicle.

According to further advantageous use, a side impact member with increased deformation resistance can be produced from the profile component. Side impact members of this type are integrated into the body, in order to increase the body rigidity and thereby improve the protection and stability of the passenger cell, particularly in the event of a side impact. By a profile component hardened in regions being used, a structural failure in the tie-up region to the door structure and consequently in the region mainly subjected to crash load can advantageously be prevented.

Further features and advantages of the present invention become clear from the following description of preferred exemplary embodiments, with reference to the accompanying figures in which:

BRIEF DESCRIPTION OF THE SEVERAL VIEWS OF THE DRAWING

FIG. 12 shows a perspective illustration of a basic profile of an instrument panel member with a closed profile cross section;

FIG. 13 shows an illustration of the profile cross section of a profile component of the instrument panel member according to FIG. 12;

DESCRIPTION OF THE INVENTION

Figure 1:
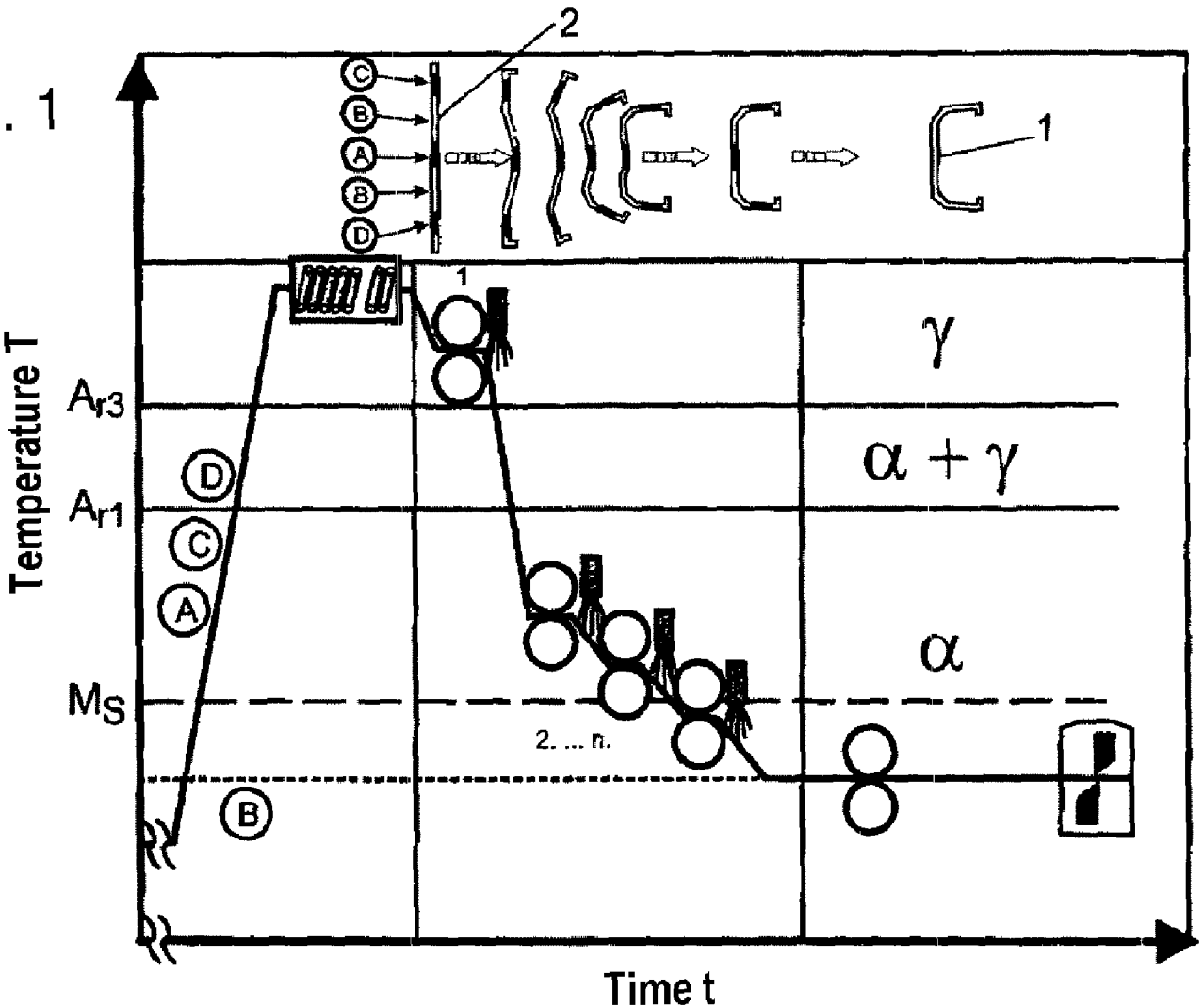
FIG. 1 shows diagrammatically the thermal and mechanical process sequences in the production of a profile component from a sheet metal semifinished product according to a first exemplary embodiment of a process of the present invention.
Figure 2:
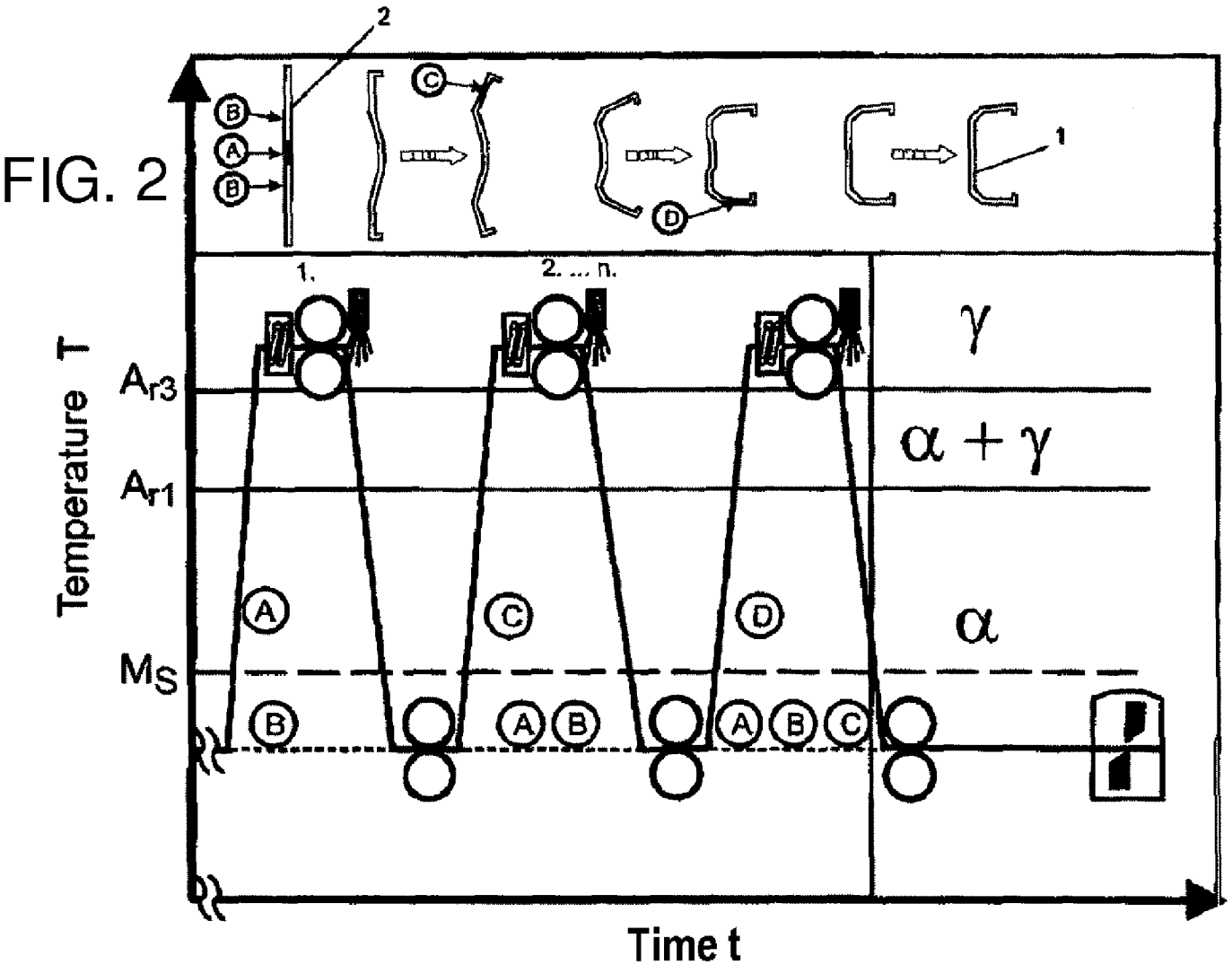
FIG. 2 shows diagrammatically the thermal and mechanical process sequences in the production of a profile component from a sheet metal semifinished product according to a second exemplary embodiment of a process of the present invention.
Figure 3:
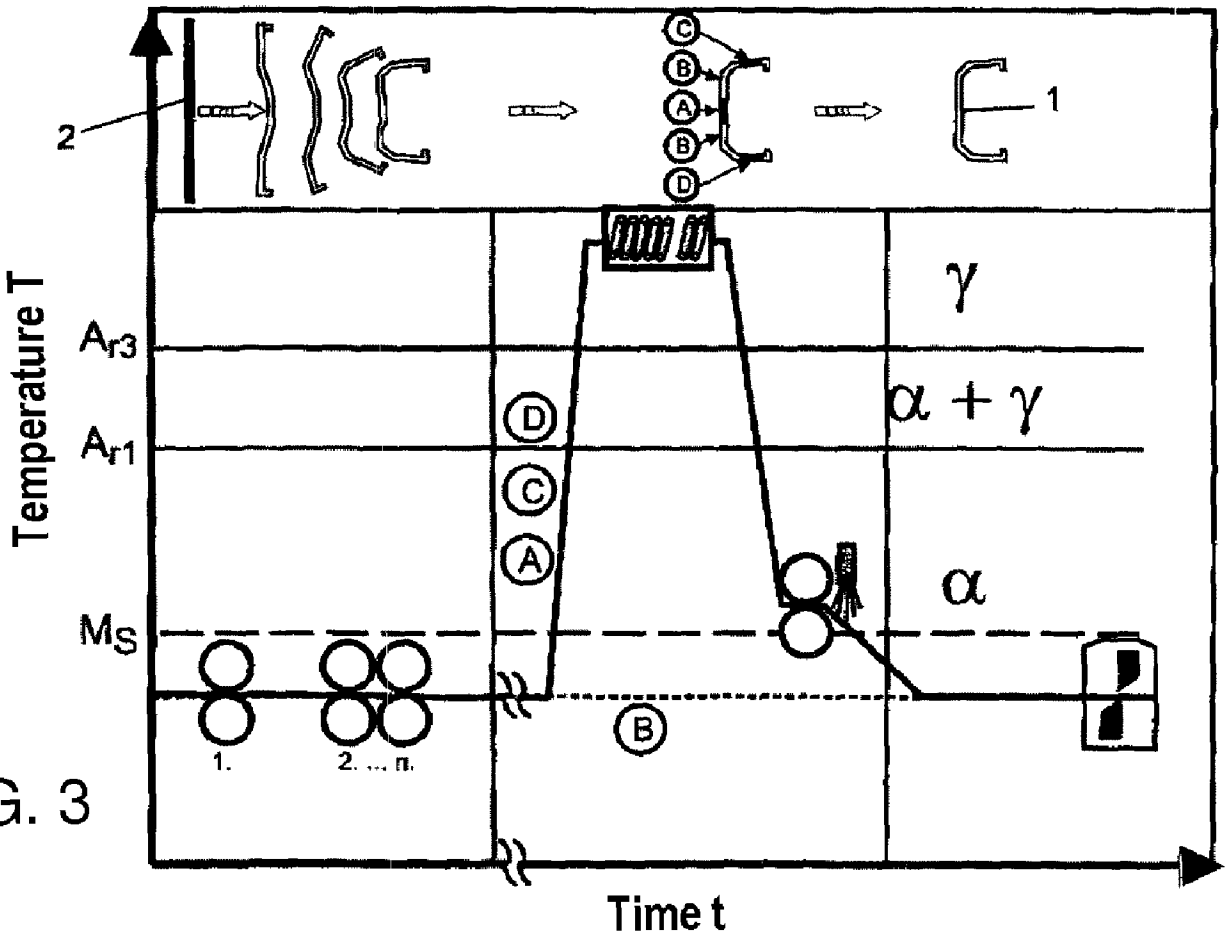
FIG. 3 shows diagrammatically the thermal and mechanical process sequences in the production of a profile component from a sheet metal semifinished product according to a third exemplary embodiment of a process of the present invention.

Referring to FIGS. 1 to 3, three different advantageous exemplary embodiments of a process for producing a profile component 1 from a preferably strip-like sheet metal semifinished product 2 will be explained in more detail below. FIGS. 1 to 3 illustrate diagrammatically for this purpose the thermomechanical process sequences in a combined heating and shaping of the sheet metal semifinished product 2 for producing the profile component 1 in a roll-profiling process which is especially preferred according to the present invention and which is carried out in a roll-profiling device.

The three preferred exemplary embodiments shown here differ from one another particularly in different process sequences in the heating of the sheet metal semifinished product 2 at least in regions before, during and after forming. What is illustrated in each case is the time-dependent profile of the temperature which prevails in defined (spatially delimited) regions A, B, C, D of the sheet metal semifinished product 2 before, during and after the individual forming steps. In order to make clear not only the temperature profile, but also the geometric shaping of the sheet metal semifinished product 2 in order to generate a desired profile cross section, in each case the forming of the sheet metal semifinished product 2 during the corresponding rolling step in the roll-profiling device is illustrated in the upper region of the figures.

Furthermore, in FIGS. 1 to 3:

1. $A_{r3}$ denotes the transformation temperature at which, during cooling, the transformation from austenite to ferrite commences. In a case of boron/manganese-alloyed tempering steels, such as, for example, 22MnB5, the transformation temperature $A_{r3}$ typically lies at 850° C.±100° C.;
2. $A_{r1}$ denotes the transformation temperature at which, during cooling, the transformation from austenite to ferrite has ended. In the case of boron/manganese-alloyed tempering steels, such as, for example, 22MnB5, the transformation temperature $A_{r1}$ typically lies at 650° C.±100° C.
3. $M_s$ denotes the transformation temperature at which, during rapid cooling, the transformation from austenite to martensite takes place abruptly. In the case of boron/manganese-alloyed tempering steels, such as, for example, 22MnB5, this transformation temperature typically lies at approximately 400° C.±100° C.
4. α denotes ferrite (during rapid cooling to a temperature below $M_s$, a microstructure variant is formed, which is designated as martensite and is distinguished by a hardened microstructure with high strength);
5. α+γ denotes that ferrite and austenite are present simultaneously. The further the temperature falls below the transformation temperature $A_{r3}$, the larger is the fraction of ferrite and the smaller is the fraction of austenite.
6. γ denotes austenite.

The bending of the sheet metal semifinished product 2, which may consist of a hardenable steel, for example of 22MnB5, and, if appropriate, may also be at least partially coated, for forming a profile component 1 with defined geometric properties is carried out, in the process variants shown in FIGS. 1 to 3, in a roll-profiling process with a number n of successive rolling steps in each of which a rolling pass is carried out. Although FIGS. 1 to 3 illustrate only profile components 1 with an open profile cross section, it will be noted at this juncture that differently shaped profile components 1 of differing complexity, with an open, with a partially open or else with a completely closed profile cross section, can be produced by means of the process presented here. There is in this case also the possibility that the profile components 1 have over their entire profile length, at least in portions, different (that is to say changing) profile cross sections, so that, in principle, profile components 1 with a profile shape of any desired complexity and with a profile cross section of any desired complexity can be produced.

In the first exemplary embodiment, illustrated diagrammatically in FIG. 1, of the process for producing a profile component 1, a heating of the sheet metal semifinished product 2 in defined, spatially delimited regions A, C and D takes place even immediately before the first rolling pass, designed by 1, in the roll-profiling device. As can be seen in FIG. 1, the sheet metal semifinished product 2 is heated, before the first rolling pass, in a middle region A and in two further outward regions C and D locally to a temperature T which is higher than the transformation temperature $A_{r3}$ at which, during cooling, the transformation from austenite to ferrite commences. By contrast, during profiling, the remaining regions B and the sheet metal semifinished product 2 are not heated and therefore are also not thermally influenced in a directed manner.

Preferably, in the defined regions A, C and D, the sheet metal semifinished product 2 is heated in a locally controlled manner to the temperature $T>A_{r3}$ by an inductive generation of the electromagnetic field or by a conductive current throughflow by means of the electrical resistance or, alternatively, by a combination of these two processes, consequently, by the dissipation of electrical energy. Alternatively, other processes and corresponding devices for the introduction of heat into the locally delimited regions A, C and D of the sheet metal semifinished product 2 can also be employed. For example, the controlled introduction of heat may take place by the sheet metal semifinished product 2 being acted upon by laser light, which is generated by at least one laser light source, or by infrared radiation, which is generated by at least one infrared radiation source, or by the use of a gas burner.

As can be seen in FIG. 1, in a first rolling pass the sheet metal semifinished product 2 is formed at falling temperature, after the maximum temperature has been reached in the regions A, C and D. The first rolling pass takes place at a temperature which still lies above the transformation temperature $A_{r3}$. The heat dissipation from the sheet metal semifinished product 2 necessarily during cooling in order to establish a desired microstructure in the locally preheated regions A, C and D of the sheet metal semifinished product may, in the first rolling pass of the roll-profiling process, take place, for example, by heat conduction in contact with the rolls of the roll-profiling device. The rolls of the roll-profiling device may, if appropriate, also be operated, cooled. Alternatively or additionally, the dissipation of heat from the preheated regions A, C and D of the sheet metal semifinished product 2 may also take place by means of media-based cooling, during which the sheet metal semifinished product is acted upon by a liquid or gaseous coolant.

It can be seen, further, that the rolling passes 2 . . . n following the first rolling pass, which are necessary for the further forming of the sheet metal semifinished product 2 to generate the final geometry of the profile component 1, take place, in this exemplary embodiment, at temperatures which always lie below the transformation temperature $A_{r1}$ and at which, during cooling, the transformation from austenite to ferrite has ended. The last (nth) rolling pass, which is necessary for configuring the profile component 1, in this exemplary embodiment takes place at a temperature which is lower than the transformation temperature $M_s$ at which, during rapid cooling, the transformation from austenite to martensite takes place abruptly. Alternatively, however, the last rolling pass may also take place at a temperature which is higher than the transformation temperature $M_s$.

Furthermore, in this exemplary embodiment, the nth rolling pass which ends the actual forming of the profile component 1 is also followed by what is known as a calibrating pass which is carried out by means of a suitable calibrating tool. The variation in the geometry of the profile component 1 which sometimes arises due to the occurrence of thermally induced inherent stresses can advantageously be compensated in a concluding rolling pass, the calibrating pass, immediately after the simultaneously occurring dissipation of heat from the work piece. In a process step subsequent to the calibration pass, the profile component 1 is brought to the desired length by means of a separating and cutting device.

The process variant described here is advantageous particularly when, as a result of the influence of heat, a significant increase in strength due to what is known as transformation hardening has occurred in the defined regions A, C and D of the sheet metal semifinished product 2. The locally defined regions A, C and D then have a drastically increased resistance to further deformation in a subsequent rolling step. This consequently means that preferably only those regions of the sheet metal semifinished product 2 should undergo such heat treatment which no longer experience any appreciable deformation in the further process sequence. A forming of previously hardened regions A, C and D of the sheet metal semifinished product 2 therefore does not take place on account of their low formability, of the failure risk resulting from this and, furthermore, also of the high forming forces to be expected.

Referring to FIG. 2, a second exemplary embodiment of a process for producing a profile component 1 from a sheet metal semifinished product 2 is explained in more detail below. In this variant of the process, a heating of the sheet metal semifinished product 2 takes place in the defined regions A, C and D successively during the roll-profiling, in each case between the individual rolling steps. As can be seen in FIG. 2, before the first rolling pass a first (middle) region A of the sheet metal semifinished product 2 is heated locally to a temperature T which is higher than the transformation temperature $A_{r3}$ (austenitizing temperature).

By contrast, the remaining regions of the sheet metal semifinished product 2 initially undergo no directed thermal influence.

After the defined preheating of the first region A, the first rolling pass is carried out in the roll-profiling device. Subsequently, the region A of the sheet metal semifinished product 2 is cooled again to a temperature which is lower than the transformation temperature $M_s$. Cooling may again take place by heat conduction upon contact of the sheet metal semifinished product 2 with the rolls of the rolling device which, if appropriate, are operated, cooled, and/or media-based, by the action of a liquid or gaseous coolant upon the sheet metal semifinished product 2, in particular the locally preheated region.

In a next heating step, a second (near-edge) region C of the sheet metal semifinished product 2 is heated locally to a temperature T which is higher than the transformation temperature $A_{r3}$. The remaining regions, in particular the regions A and B, of the sheet metal semifinished product 2 are, by contrast, not heated in a directed manner in this process step. Subsequently, a second rolling pass is carried out in order further to profile the sheet metal semifinished product 2. As can be seen in FIG. 2, the preheated region C of the sheet metal semifinished product 2 is again cooled after the rolling pass to a temperature which is lower than the transformation temperature $M_s$.

Correspondingly, in a further heating step which, if appropriate, may also be preceded by further rolling passes, in which no local heating of the sheet metal semifinished product 2 has taken place, a further (near-edge) region D is heated locally to a temperature T which again is higher than the transformation temperature $A_{r3}$. The remaining regions, in particular the regions A, B and C, of the sheet metal semifinished product 2 are, by contrast, not locally heated in a directed manner. Subsequently, a further rolling pass is carried out in order further to profile the sheet metal semifinished product 2. As can be seen in FIG. 2, after this rolling pass the region C of the sheet metal semifinished product 2 is cooled again to a temperature which is lower than the transformation temperature $M_s$. This rolling pass may, if appropriate, be followed by further rolling passes which may be carried out with or without the preheating of locally defined regions of the sheet metal semifinished product 2. The directed heating of the regions A, C and D of the sheet metal semifinished product 2 may, in this exemplary embodiment too, take place with the aid of the processes or devices described above.

In this exemplary embodiment too, a last rolling pass, which ends the profiling of the sheet metal semifinished product 2 into a profile component 1, may be followed by a calibrating pass in a calibrating device, before the profile component 1 is thereafter cut to its desired length by means of a separating and cutting device.

Here, therefore, the heat treatment of the sheet metal semifinished product 2 does not take place before the commencement of the actual profile production by roll-profiling or after profile forming has taken place, but, instead, takes place in a directed manner in a plurality of intermediate steps. In this case, the positioning of these heat treatment intermediate steps is carried out according to clear methodical principles:

- positioning of local heat treatment according to the need for a simultaneous increase in the local forming capacity,
- positioning of local heat treatment whenever the strain hardening which has taken place in the preceding cold-forming steps has led to a residual forming capacity which is not sufficient for further forming and which can be increased again by means of thermally induced softening over the extent necessary for subsequent forming,
- positioning of local heat treatment whenever the respective geometric regions of the sheet metal semifinished product 2 are not exposed to any appreciable forming in the further process sequence.

The process variant shown in FIG. 2 is advantageous particularly when, on the one hand, it is appropriate to reduce in a directed manner the resistance to a change, wanted in the immediately following rolling step, in the geometric shape of the sheet metal semifinished product 2, and, on the other hand, it is desirable to establish in a directed manner the microstructure of these regions after the local geometric shaping which has already taken place in the preceding rolling passes. Insofar as the directed change in the microstructure is also accompanied by a strength increase, the deformation resistance being raised at the same time, it is advantageous in this exemplary embodiment, too, that preferably only those regions of the sheet metal semifinished product 2 which no longer undergo any further (appreciable) deformation in the further process sequence experience directed heat treatment. In other words, only those regions of the flat sheet metal semifinished product 2 which are subject to no direct forming during the subsequent roll-profiling steps undergo partial thermal treatment by heating and cooling.

FIG. 3 shows a third preferred exemplary embodiment of a process for producing a profile component 1 from a sheet metal semifinished product 2. In contrast to the two exemplary embodiments described above, in this variant of the process the heating in the locally defined regions A, C and D of the sheet metal semifinished product 2 takes place only after the conclusion of the generation of the final geometry of the profile component 1 in a preceding sequence of n rolling passes in the roll-profiling device. The profiling of the sheet metal semifinished product 2 therefore takes place at an ambient temperature which is substantially lower than the transformation temperature $M_s$. It becomes clear that the defined regions A (central) and C and D (near-edge) of the sheet metal semifinished product 2 are simultaneously heated, after forming, to a temperature T which is higher than the transformation temperature $A_{r3}$.

In this exemplary embodiment, the local heating of the regions A, C and D taking place after the final shaping of the sheet metal semifinished product 2 into a profile component 1 serves solely for the purpose of a thermally induced increase in strength of the profile component 1 by means of transformation hardening. The variation in the geometry of the profile component 1 sometimes occurring in this case due to the generation of thermal induced inherent stresses can advantageously be compensated in a concluding rolling pass, what is known as the calibrating pass, immediately after the heat dissipation which here takes place simultaneously. The regions A, C and D locally heated in a directed manner are therefore cooled again, so that the calibrating pass can be carried out in the calibrating tool at a temperature which is somewhat higher than the transformation temperature $M_s$.

The directed local heating and subsequent cooling of the spatially delimited regions A, C and D of the sheet metal semifinished product 2 may take place in the way already stated in more detail above with reference to FIGS. 1 and 2.

Preferably, in the process variants described here, the directed local heating of the sheet metal semifinished product 2 does not take place solely by means of heating devices, integrated specifically for this purpose into the process sequence, on an inductive or even conductive basis (for example, by means of inductors or conductive contact elements), but by means of electrical resistance heating during the contact with the shaping tools (rolling rolls) which in any case takes place for the purpose of transmitting the shaping force.

In all the process variants presented here, the cooling of the sheet metal semifinished product 2 advantageously does not take place solely via a direct dissipation of heat by the action of fluid coolants (preferably water) and/or gaseous coolants (preferably compressed air), but also by heat conduction via the contact of the sheet metal semifinished product 2 with the shaping forming tools (here, rolling rolls). The rolling rolls may be equipped for this purpose with internal cooling in which the heat is transported away by means of a cooling medium in a circulation system via cooling ducts introduced correspondingly in the interior of the tool. Consequently, in an especially advantageous way, heat dissipation can be controlled substantially more accurately with a view to a directed establishment of a microstructure than is conceivable at all with straightforward media cooling. The cooling of the sheet metal semifinished product 2 may take place, for example, by heat conduction via contact with the shaping tools (rolling rolls), in combination with a direct cooling of the sheet metal semifinished product 2, for example by means of a gas, supercooled if appropriate, or by means of particularized ice (preferably dry ice). In this case, the gas or dry ice is blasted at high pressure into the exit of the roll stand onto the sheet metal semifinished product surface (rolling stock surface) on both sides. In this case, by blasting into the roll nip, a cooling of the rolling rolls can take place at the same time in an especially advantageous way. By means of the particularized ice, advantageously, additional surface dirt and/or oxidation residues, scale or the like are removed from the surface of the rolling stock and/or from the surfaces of the rolls. Consequently, the controllability of heat dissipation with a view to a directed establishment of a microstructure is substantially improved even further. This cannot be achieved at all in this way by means of straightforward quench cooling by means of fluid or gaseous cooling media, such as is used in the prior art.

Figure 4A:
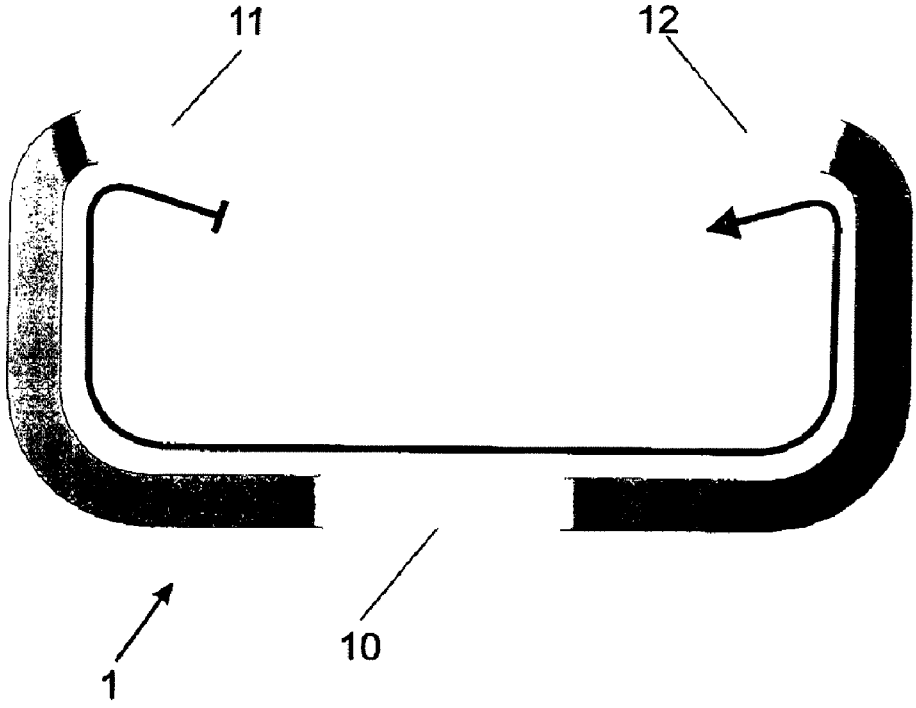
FIG. 4*a* shows a first exemplary embodiment of a profile component which has been produced by means of the process presented here and which has a plurality of zones of definedly increased strength.
Figure 4B:
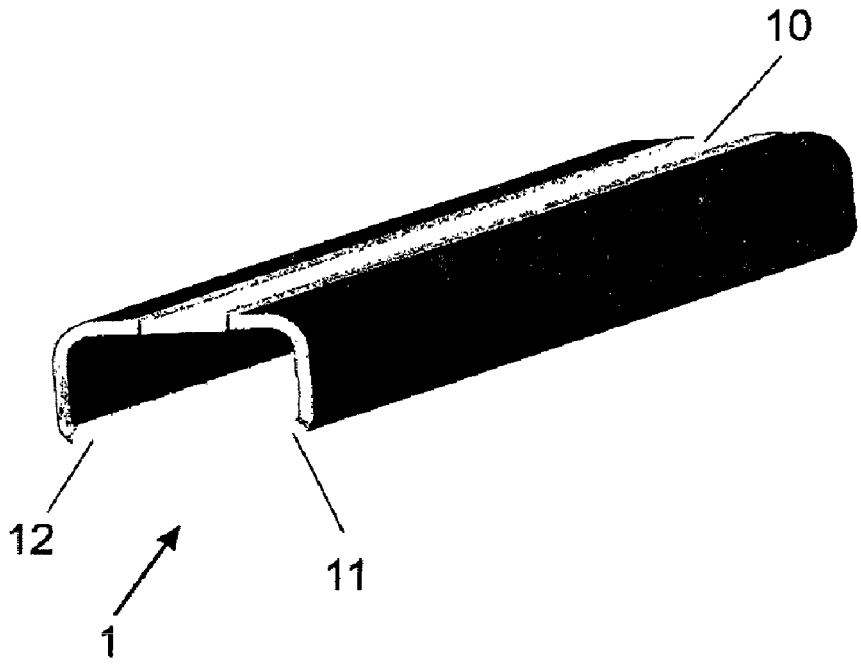
FIG. 4*b* shows a perspective illustration of the profile component according to FIG. 4*a;*

FIGS. 4*a* and 4*b* illustrate a first exemplary embodiment of a profile component 1 which can be produced with the aid of one of the processes presented here. The profile component 1 has an open profile cross section and has three regions 10, 11, 12 which, as compared with the remaining regions, have a structurally increased strength induced by locally heating and subsequent cooling. A first region 10 of structurally increased strength is formed in the profile base of the profile component 1. The other two regions 11, 12 with structurally increased strength are formed at the inwardly directed ends of the profile flanks. A profile component 1 of this type with three defined, spatially delimited regions 10, 11, 12, which have structurally increased strength, may be used, for example, for producing a guide rail for a safety belt with increased deformation resistance, so that an essentially slide-shaped belt fastening can be effectively prevented from coming loose from the guide rail.

Furthermore, the profile component 1 may be used to produce a guide rail for a safety belt with increased resistance to contact-related wear during the adjustment of the slide-shaped belt fastening.

Figure 5A:
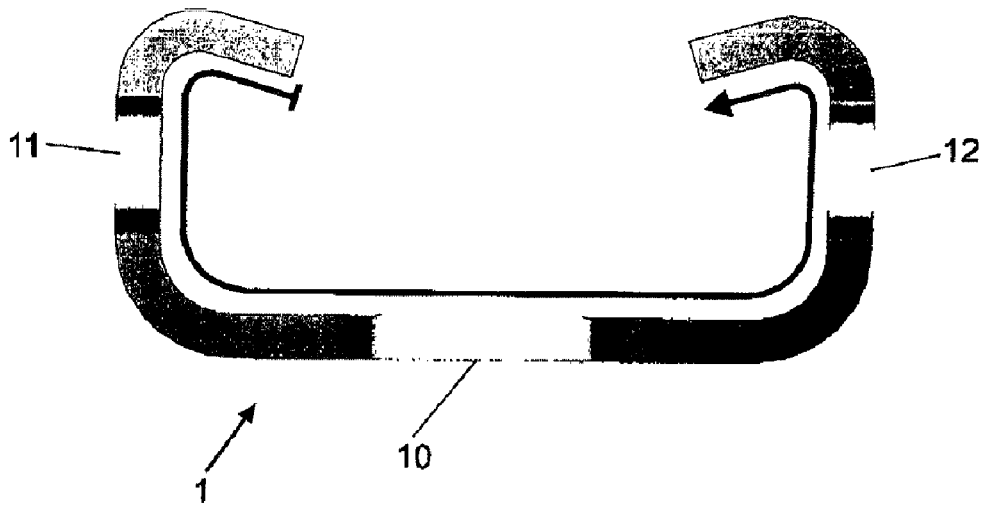
FIG. 5*a* shows a first exemplary embodiment of a profile component which has been produced by means of the process presented here and which has a plurality of zones of definedly increased strength.
Figure 5B:
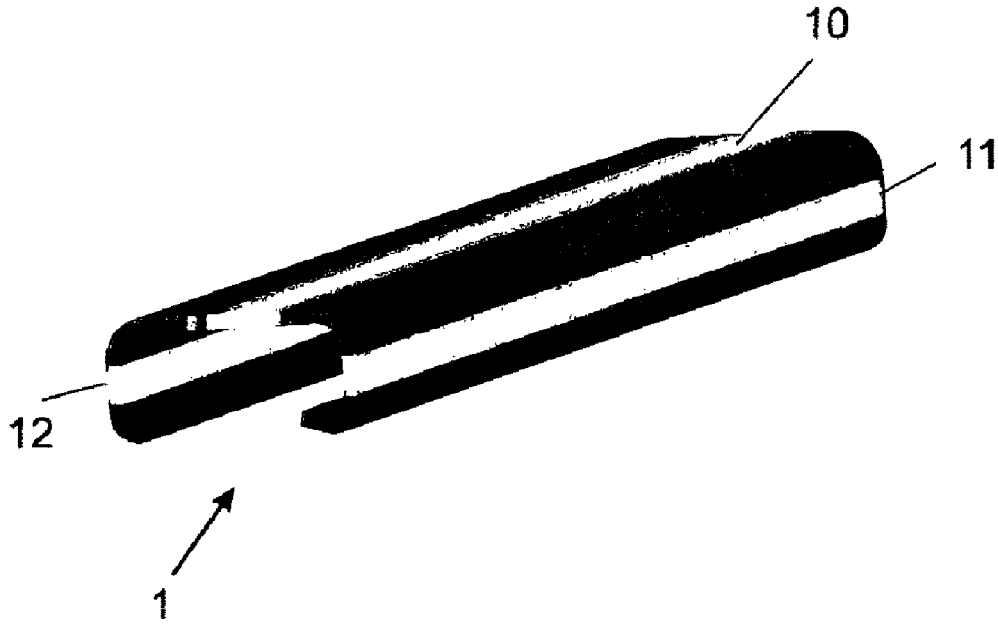
FIG. 5*b* shows a perspective illustration of the profile component according to FIG. 5*a;*

FIGS. 5*a* and 5*b* show a second exemplary embodiment of a profile component 1 which has been produced with the aid of one of the processes presented here and which may likewise be used for producing a guide rail for a safety belt having the properties described above with reference to FIGS. 4*a* and 4*b*. The profile component 1 has an open profile cross section and has three regions 10, 11, 12 which, as compared with the remaining regions, have structurally increased strength induced by local heating and subsequent controlled cooling. A first region 10 with structurally increased strength is formed, once again, in the profile base of the profile component 1. The other two regions 11, 12 with structurally increased strength are formed approximately in the middle of the profile flanks oriented essentially perpendicularly to the profile base.

Figure 6:
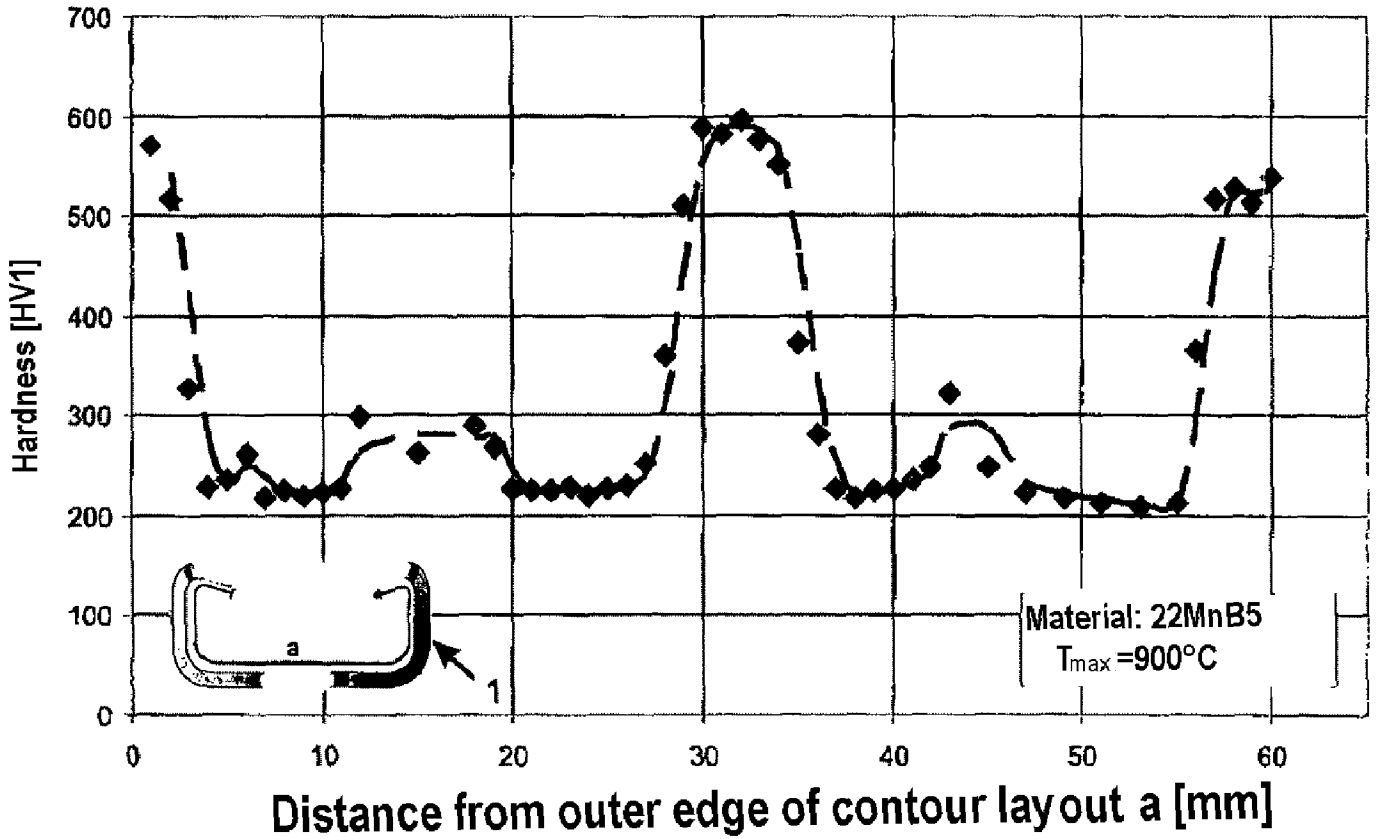
FIG. 6 shows a hardness profile against the layout of the component contour of the profile component according to FIGS. 4*a* and 4*b;*
Figure 7:
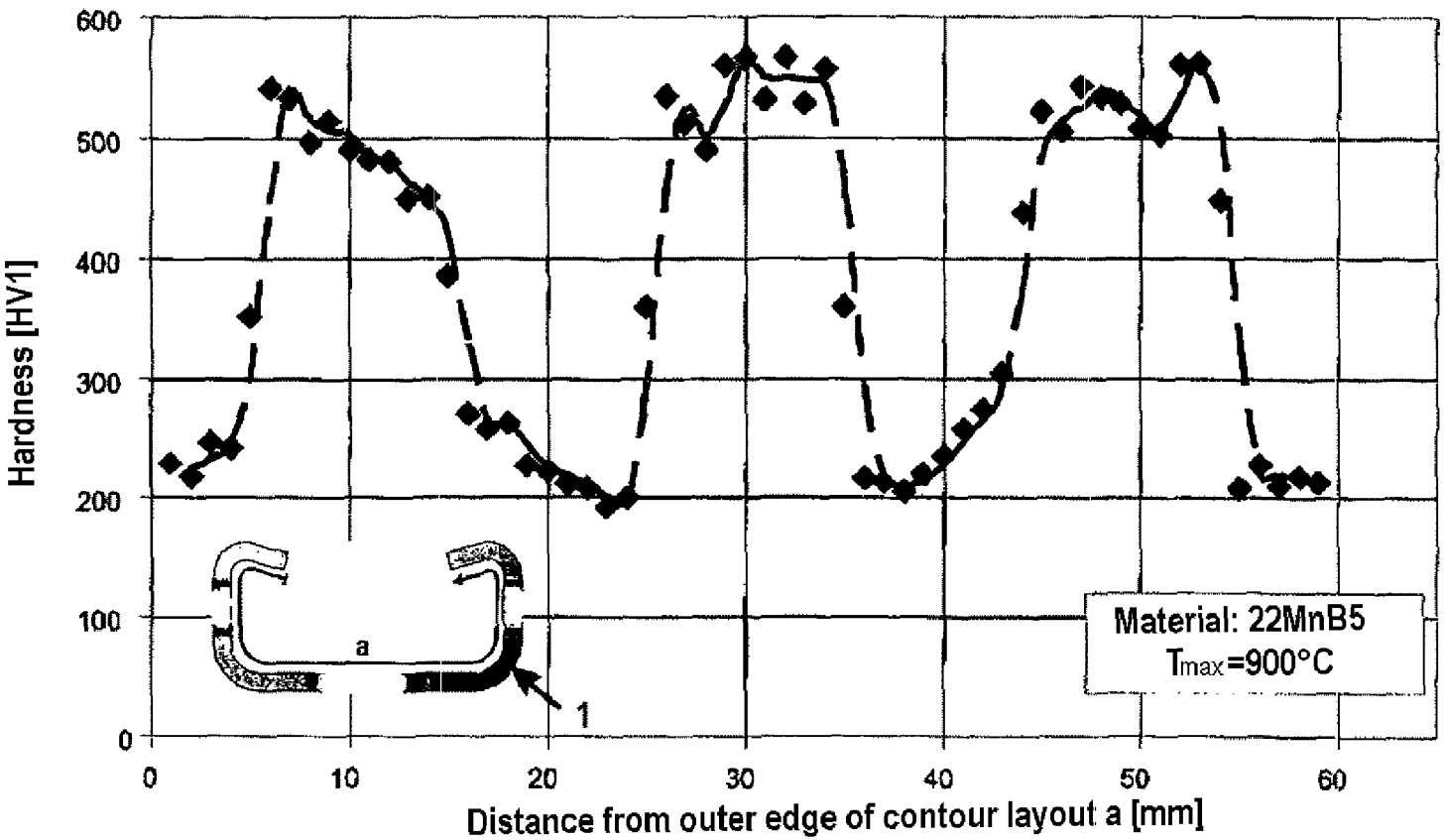
FIG. 7 shows a hardness profile against the layout of the component contour of the profile component according to FIGS. 5*a* and 5*b;*

Referring to FIGS. 6 and 7, the resulting strength profiles of the profile components 1, shown in FIGS. 4*a* to 5*b*, consisting of the material 22MnB5 will be explained in more detail below. In each case the hardness (Vickers hardness HV1), measured according to DIN EN ISO 6507-1, is plotted against the distance from the outer edge of the contour layout a. The maximum local heating temperature in the production of the profile components 1 amounted to 900° C.

The results show that the strength in the regions 10, 11, 12 locally heated and hardened during production is significantly higher than in the remaining regions of the profile component 1 which are not heat-treated. Whereas HV1 values of the order of magnitude of about 200 to 300 could be measured in the non-hardened regions, these values lay at more than 500 in the hardened regions and could, in portions, attain a value of almost 600.

Figure 8:
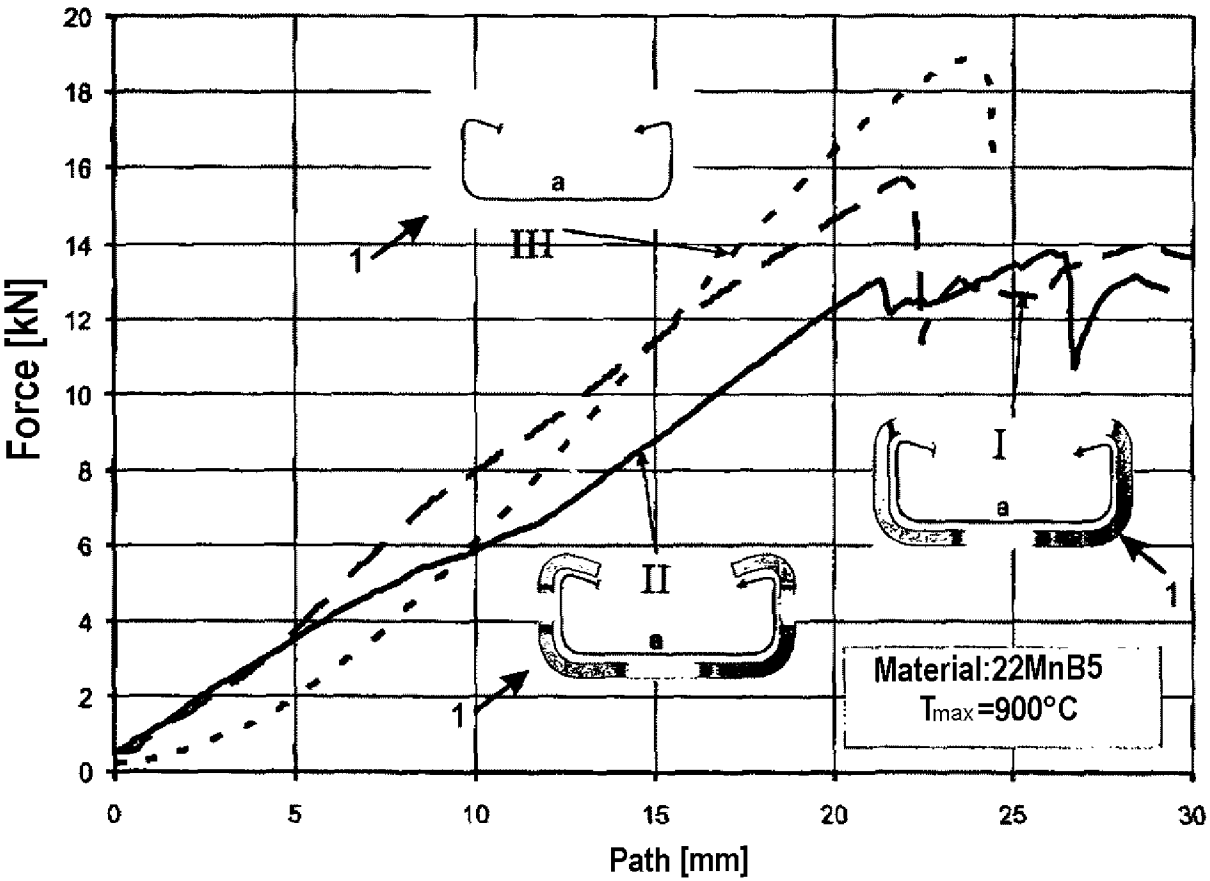
FIG. 8 shows the force/path profiles of the profile components illustrated in FIGS. 4*a*, 4*b* and 5*a*, 5*b* under tensile stress.

FIG. 8 collates graphically the results of static tensile stress tests which were carried out on three different profile components 1, 1'. In these tests, a loading direction of the profile components 1, 1' which is close to conditions during use was selected. The force/path profiles under a tensile stress are illustrated. I shows the results for the profile component 1 shown in FIGS. 4*a* and 4*b* and II shows the results for the profile component 1 shown in FIGS. 5*a* and 5*b*. III additionally designates the force/path profile of a fully hardened profile component 1'. A comparison of the measurement results shows that the two profile components 1 hardened only in regions, which were produced by means of one of the processes described here, have a lower tensile strength and a higher ductile yield than the fully hardened profile component 1'.

Figure 9:
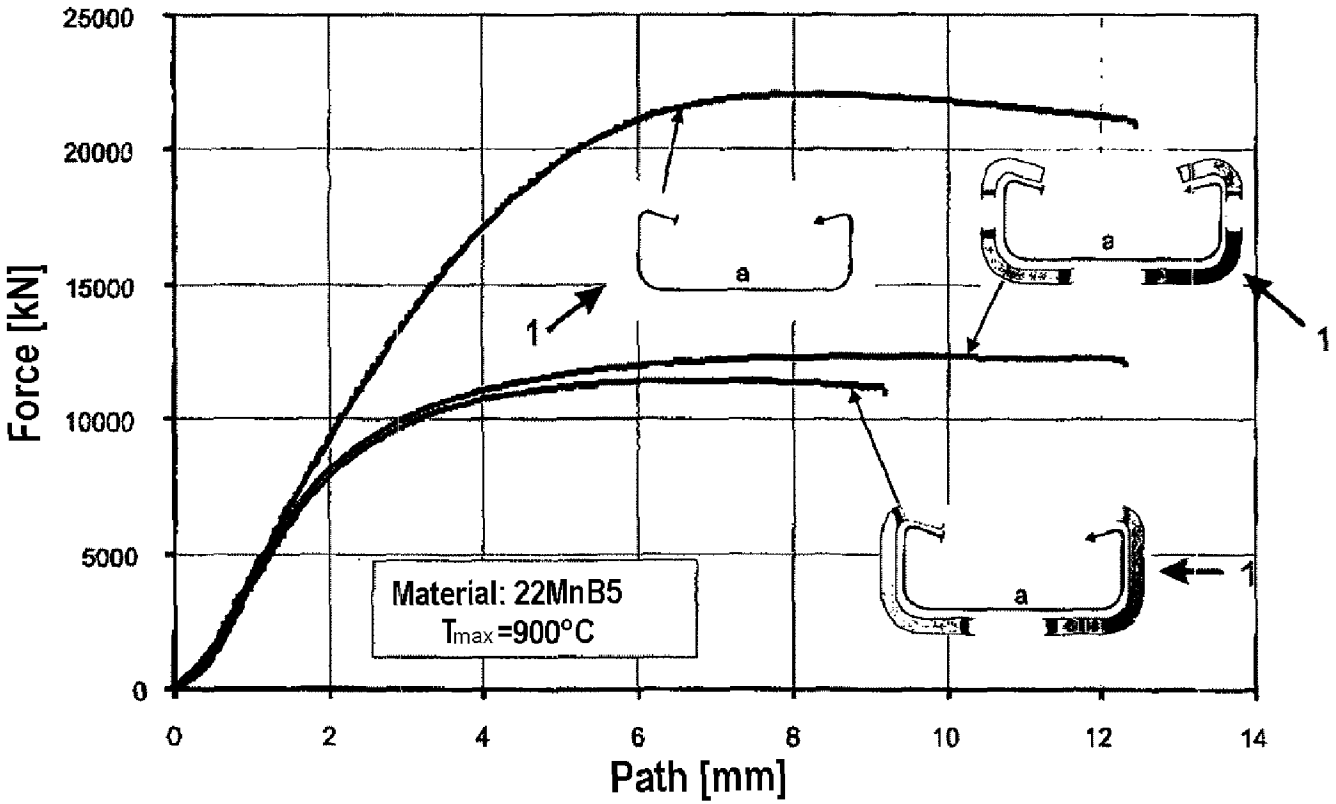
FIG. 9 shows the force/path profiles of the profile components illustrated in FIGS. 4*a*, 4*b* and 5*a*, 5*b* during a three-point bending test.

Finally, FIG. 9 illustrates the results of a three-point bending test which was carried out on the profile components 1, 1' produced by means of one of the processes presented here. In the standardized testing of the profile components 1, 1' in the three-point bending test, a marked increase in the load-bearing capacity is likewise shown, which, in the present stress situation, proved to be the most beneficial for the fully hardened profile component 1'.

Referring to FIGS. 10 to 14, some examples of the use of the profile components 1, 1' which are produced by means of the processes explained in more detail above and which at least in regions have a structurally increased strength will be explained in more detail below.

Figure 10:
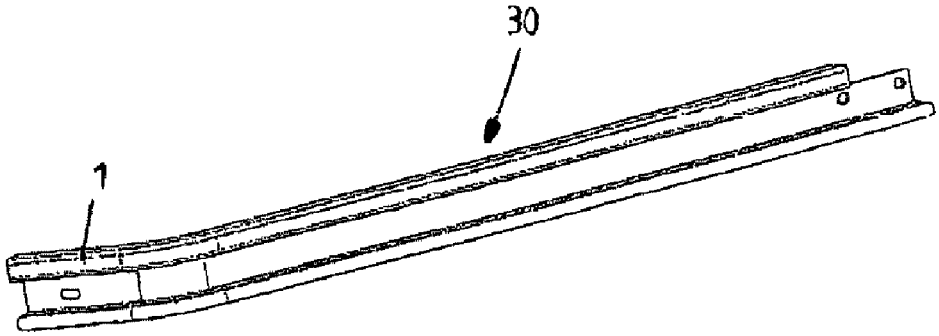
FIG. 10 shows a perspective illustration of a guide rail for a door, seat or the like of a motor vehicle.
Figure 11:
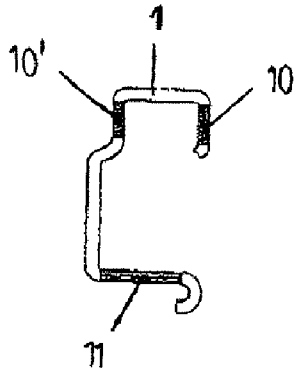
FIG. 11 shows an illustration of the profile cross section of the guide rail according to FIG. 10.

FIGS. 10 and 11 illustrate a guide rail 30 which is suitable, for example, for a door, seat or belt of a motor vehicle. The guide rail 30 was produced, using a profile component 1 hardened in regions. As can be seen particularly in FIG. 11, the profile component 1, from which the guide rail 30 was produced, has in this exemplary embodiment a first and a second partially hardened region 10, 10', which are arranged opposite one another, and a fully hardened region 11. The at least partially hardened regions 10, 10', 11 improve, in particular, the deformation resistance to the loosening of an essentially slide-shaped belt fastening from the guide rail 30 and, furthermore, deliver increased resistance to contact-related wear during the adjustment of the belt fastening. It should be noted at this juncture that the positions of the at least partially hardened regions 10, 10', 11 of the profile component 1 are merely by way of example and, during the production of the profile component 1 with the aid of one of the processes presented here, can be adapted in a directed manner to the later use of the guide rail 30.

A further example of the use of the profile components 1, 1' presented here is shown in FIGS. 12 and 13. This is a basic profile 31 of an instrument panel member which, in this example, is produced from two closed and interconnected profile components 1, 1', having different profile cross sections.

The first profile component 1 has, approximately in its middle, a region 10 of flattened design which is partially hardened and which is provided for a tie-up of the steering column of the motor vehicle. In this exemplary embodiment, the second profile component 1' has a fully hardened region 11 which is provided for the airbag region. The basic profile of the instrument panel member 31 may also be produced, in further advantageous embodiments, using an individual profile component 1, 1' or using more than two profile components 1, 1'. A further advantageous use of the profile components 1, 1' is in the production of a module crossmember, in particular (part of) an instrument panel member, with an optimized characteristic frequency behaviour, in order to avoid undesirable vibrations and consequently improve the acoustics in the interior of the vehicle.

Figure 14:
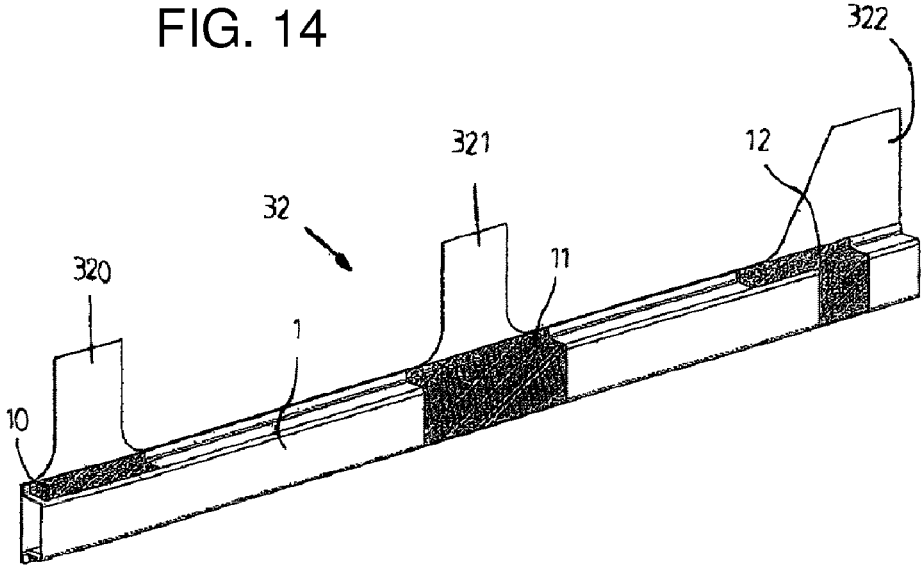
FIG. 14 shows a perspective view of a member component of a motor vehicle.

Finally, FIG. 14 shows a longitudinal member 32, designed as an open structural profile, of a motor vehicle. The longitudinal member 32 was produced from a profile component 1 which has a first partially hardened region 10, a second fully hardened region 11 and a third region 12 which is fully hardened in portions and is partially hardened in portions. Furthermore, the longitudinal member 32 has three mounting portions 320, 321, 322, which may be (but do not necessarily have to be) part of the profile component 1, for the tie-up of the longitudinal member 32 to the A-column, B-column or C-column of a vehicle. In this case, in this exemplary embodiment, the first mounting portion 320 is provided for the A-column, the second mounting portion 321 for the B-column and the third mounting portion for the C-column.

Figure 15A:
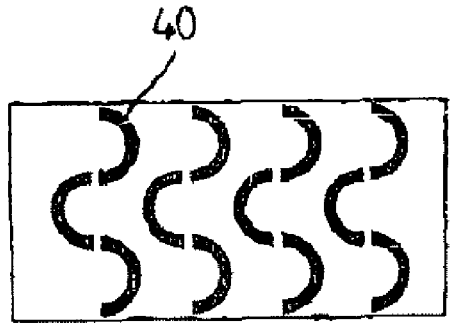
FIG. 15*a* shows a diagrammatic illustration of a first heating pattern for heating the sheet metal semifinished product.
Figure 15B:
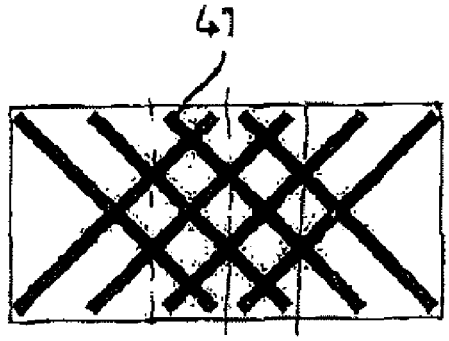
FIG. 15*b* shows a diagrammatic illustration of a second heating pattern for heating the sheet metal semifinished product.
Figure 15C:
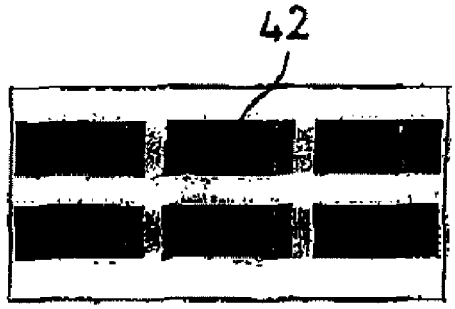
FIG. 15*c* shows a diagrammatic illustration of a third heating pattern for heating the sheet metal semifinished product.

Finally, FIGS. 15*a* to 15*c* illustrate three different patterns 40, 41, 42 of a heating zone in which the sheet metal semifinished product 2 can be heated at least in portions. In principle, freely selectable profiles and shapes of various types of the heating zone patterns may be envisaged.

The invention claimed is:

1. A method for producing a profile component, having at least portions of structurally increased strength, from a sheet metal semifinished product including a plurality of spatially delimited regions, the method comprising the steps of:

heating a first spatially delimited region of the sheet metal semifinished product to an initial temperature being higher than an austenitizing temperature $A_{r3}$ of the sheet metal semifinished product;

cooling the heated first spatially delimited region for commencing a transformation of the first spatially delimited region from austenite to ferrite;

bending the first spatially delimited region after cooling; and heating at least one further spatially delimited region of the sheet metal semifinished product to a temperature which is higher than the austenitizing temperature $A_{r3}$ of the sheet metal semi-finished product, before further bending of the sheet metal semifinished product.

2. The method according to claim 1, wherein the bending occurs in a stationary member.

3. The method according to claim 1, wherein the bending comprises a plurality successive cooled rolling steps.

4. The method according to claim 3, wherein a first rolling step is carried out in a roll-profiling device at a temperature of the first preheated spatially delimited region which is higher than the austenitizing temperature $A_{r3}$ of the sheet metal semifinished product.

5. The method according to claim 4, wherein at least one further rolling pass is carried out in the roll-profiling device at a temperature of the second preheated spatially delimited region which is higher than the austenitizing temperature $A_{r3}$ of the sheet metal semifinished product.

6. The method according to claim 1, wherein heating the spatially delimited regions comprises inductively generating an electromagnetic field or a conductive current.

7. The method according to claim 1, wherein heating the spatially delimited regions comprises at least one or more of at least one laser light source, at least one infrared light radiation source, or at least one gas burner source.

8. The method according to claim 1, including the further step of generating a heating pattern on the sheet metal semifinished product.

9. The method according to claim 1, wherein cooling comprises a liquid-based or gas-based cooling device.

10. The method according to claim 1, wherein cooling comprises heat conduction contacting the sheet metal semifinished product with a shaping tool and directly cooling the sheet metal semifinished product.

11. The method according to claim 1, wherein after each heating of a spatially delimited region, the region is cooled to a temperature which is lower than a transformation temperature $M_s$ of the sheet metal semifinished product such that abrupt transformation from austenite to marten site takes place during rapid cooling.

12. The method according to claim 1, including the further step of calibrating the sheet metal semifinished product after profiling is substantially completed.

13. The method according to claim 12, wherein a further calibration is carried out in the calibrating tool.

14. The method according to claim 1, including the further steps of cutting and separating the profile component into desired lengths.

* * * * *